United States Patent [19]

Focke et al.

[11] Patent Number: 4,829,752

[45] Date of Patent: May 16, 1989

[54] DEVICE FOR ACTUATING SEALING JAWS OF A PACKAGING MACHINE

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 109,895

[22] Filed: Oct. 19, 1987

[30] Foreign Application Priority Data

Oct. 24, 1986 [DE] Fed. Rep. of Germany ..... 3636242

[51] Int. Cl.[4] ..... B65B 51/14; B30B 15/34

[52] U.S. Cl. ..... 53/379; 53/375; 156/359; 156/583.1

[58] Field of Search ..... 53/375, 379, 373, 388, 53/77; 156/359, 583, 358, 306

[56] References Cited

U.S. PATENT DOCUMENTS

| | | | |
|---|---|---|---|
| 3,979,881 | 9/1976 | Seragnoli | 53/379 X |
| 3,982,380 | 9/1976 | Seragnoli | 53/379 X |
| 3,984,963 | 10/1976 | Seragnoli | 53/379 X |
| 4,330,977 | 5/1982 | Focke | 53/379 |
| 4,585,503 | 4/1986 | Von Wichert et al. | 53/379 X |

*Primary Examiner*—Horace M. Culver

*Attorney, Agent, or Firm*—Sughrue, Mion, Zinn, Macpeak and Seas

[57] ABSTRACT

In order to control the pressing-on time of sealing jaws in the sealing of folding tabs consisting of sealable packaging material, a cam element, of which the cam part or cam body 17 has a cam recess 20 of irregular shape, is used. A sensing member (tracer roller 16) is adjustable relative to the cam element as a function of the working speed of an associated packaging machine, so that different regions of the cam element which guarantee an always constant pressing-on time of sealing jaws 12 take effect.

12 Claims, 3 Drawing Sheets

DEVICE FOR ACTUATING SEALING JAWS OF A PACKAGING MACHINE

BACKGROUND OF THE INVENTION

1. Field of the Invention

The invention relates to a device for actuating sealing jaws and for controlling their pressing-on time, especially for the sealing of folding tabs of a packaging blank in conjunction with a packaging machine.

2. Description of the Prior Art

Packaging machines are equipped with welding or sealing members, in particular heated sealing jaws, when articles are wrapped in sealable packaging material. During the production of the cigarette pack, its outer wrapping, consisting of thermally weldable film, is provided in the region of end faces with folding tabs overlapping one another. These are fixed in their closing position by sealing. To carry out the sealing operation, the (heated) sealing jaws are brought up against the faces of the packs to be sealed or up against the folding tabs for a limited period of time.

The sealing time, in particular the time during which the sealing jaws rest against the packs, has to be adhered to exactly in the light of the technological properties of the packaging material and with other circumstances being taken into account. It becomes more difficult to ensure exact, constant sealing times, at the same time with a predetermined pressure and a specific temperature of the sealing jaws, because the packs to be sealed can be transported at changing speeds within the packaging machine. This is because of necessary variations in the cycle time or cycle rate of the packaging machine. During operation, in principle at least three different performance ranges of the packaging machine can occur: normal speed corresponds to the predetermined output of the packaging machine, for example 400 cycles per minute in the production of cigarette packs. To carry out work on the packaging machine, for example in order to eliminate defective packs, etc., crawling speed is set, and under these conditions the packaging machine runs at a much reduced cycle rate, for example at 200 cycles per minute. Finally, packaging machines are equipped with a so-called overdrive which for a short time allows cycle rates above the normal speed.

SUMMARY OF THE INVENTION

Starting from this, the object on which the invention is based is to provide measures which guarantee a constant pressing-on time and consequently sealing time, conforming to the particular requirements, of the welding or sealing members for each work cycle of the packaging machine, irrespective of the cycle rate of the latter per unit time.

To achieve this object, the device according to the invention is characterized in that a pressing-on member for the sealing jaws is controllable by means of a cam element, of which the cam characteristic sensed by a sensing member is variable as a function of the cycle rate (speed) of the packaging machine.

The invention assumes that one sealing cycle of the sealing jaws is to be executed for each work cycle of the packaging machine. The pressing-on time of the sealing jaws on the packs or the like is determined by a cam element, the control cam of which is sensed by a sensing member (tracer roller) movable relative to the cam element and is converted into movements for the sealing jaws.

According to the invention, the cam element can be designed in various ways. It is advantageous to have an elongate, approximately cylindrical cam body, on the casing of which is arranged a cam recess extending in the longitudinal direction and having a variable transverse or peripheral dimension. Here, the cam body is driven to rotate about the longitudinal axis, and the sensing member (tracer roller) runs on the casing of the cam body in the peripheral direction. The cam recess determines, here, the actuation time (pressing-on phase) of the sealing jaws. A variation is obtained by means of axial displacement of the cam body, as a result of which the sensing member moves into another region of the cam recess. The axial displacement of the cam body takes place as a function of variations in the cycle rate (speed) of the packaging machine.

In an alternative version, the cam body is designed as a preferably circular cam disc which, on a free sensing face, has an approximately radially directed cam recess. This too has a shape (width) varying in the radial direction, so that a tracer roller running on the cam disc during the rotation of the latter intermittently enters the cam recess and thereby actuates the sealing jaws to sealing effect. The tracer roller is adjustable in terms of its radial position relative to the cam disc, so that a constant sealing time is guaranteed even when the cycle rate of the packaging machine changes.

In the invention, the cam elements can be driven directly from the packaging machine, for example, via a machine shaft. The rotational speed of the cam element can correspond to the cycle rate or speed of the packaging machine, so that, when the packaging machine runs slowly, the cam element likewise has a lower rotational speed. At the same time, the sensing member must be brought into a narrow region of the cam recess, in order to ensure that the sealing time is maintained unchanged despite a lower rotational speed.

BRIEF DESCRIPTION OF THE DRAWINGS

Exemplary embodiments of the invention are explained in detail below with reference to the drawings. In the drawings.

DETAILED DESCRIPTION OF THE PREFERRED EMBODIMENTS

The devices illustrated are used in conjunction with a packaging machine for cuboid packs 10, especially cigarette packs. The operation involves the sealing of folding tabs of an outer wrapping made of sealable film for the packs 10. The folding tabs (not shown in detail) are located in the region of end faces 11 of the packs 10. The latter are preferably transported intermittently along a horizontal conveyor track (not shown) belonging to the packaging machine. The end faces 11, having the folding tabs to be sealed, are directed to the side. During a standstill phase of the packs 10, the folding tabs are sealed as a result of the application of heat and pressure. The design and functioning of the conveyor track for the packs 10 in relation to packaging machines for cigarettes are generally known.

Figure 1:
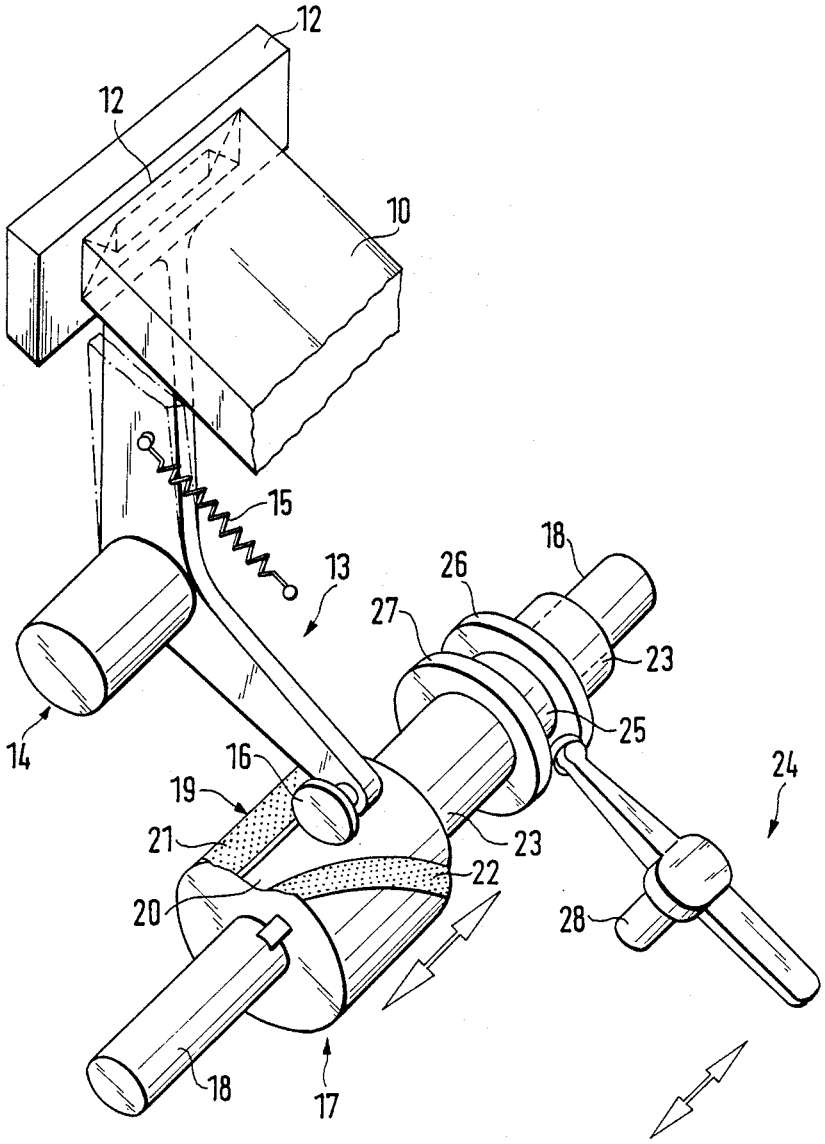
FIG. 1 shows an embodiment of the device in a diagrammatic perspective representation.

A heated sealing jaw 12 serves here for sealing the folding tabs, and as a result of a pivoting movement out of a retracted position this sealing jaw is moved into the sealing position, at the same time coming up against the end face 11 of the pack 10 (as represented by unbroken lines in FIG. 1).

For this purpose, the sealing jaw 12 is attached to an actuating member, in the exemplary embodiment of FIG. 1 to an angular two-armed pressing-on lever 13. The pressing-on lever 13 is movable in the vertical plane about a fixed pivot bearing 14. The sealing jaw 12 and the pressing-on lever 13 are permanently pressed into the sealing position by means of an elastic pressing-on member. In the present case, a tension spring 15 is attached to the upper part of the pressing-on lever 13 and loads the pressing-on lever in the anti-clockwise direction, that is to say towards the sealing position.

The sealing time, that is to say the phase during which the sealing jaw 12 is up against the pack 10, is determined by a control member which, independently of the working speed (cycle rate or cycle time) of the packaging machine, fixes a predetermined, limited sealing time and, after this has ended, causes the pressing-on lever 13 to execute a pivoting movement in the clockwise direction. For this purpose, the free end of the pressing-on lever 13 runs by means of a sensing member, in particular a tracer roller 16, on a cam element, the cam characteristic of which is variable as a function of the change in speed of the packaging machine.

In the exemplary embodiment of FIG. 1, the cam element consists of an elongate, approximately cylindrical cam body 17. This is mounted on a drive shaft 18 and can be driven to rotate by the latter. The drive shaft 18 or its axis of rotation is directed parallel to the axis of rotation of the pivot bearing 14 for the pressing-on lever 13. The cam body 17 is equipped, on the cylindrical outer face, in particular the outer casing 19, with a control cam which, here, takes the form of a cam recess 20. During a revolution of the cam body 17, the tracer roller 16, running on the casing 19 in the peripheral direction of the cam body 17 during the rotation of the latter, enters the cam recess 20 intermittently. During this time, the sealing jaw 12 is brought up against the pack 10 as a result of the action of the tension spring 15. Outside the region of the cam recess 20, the tracer roller 16 causes the sealing jaw 12 to assume an (initial) position lifted off from the pack 10.

The cam recess 20 has a shape varying over the axial length of the cam body 17, in order to ensure that the cam recess 20 has different dimensions in the peripheral direction in different peripheral regions. For this purpose, lateral limitations of the cam recess 20, in particular cam flanks 21 and 22 extending in the longitudinal direction of the cam body 17, are made to converge or diverge relative to one another in the longitudinal direction of the cam body 17. In the exemplary embodiment illustrated, one cam flank 21 is made to extend along the generatrix, that is to say axis-parallel, whereas the other opposite cam flank 22 has a curved shape, so that the cam recess 20 as a whole acquires a funnel-shaped form. In the illustration according to FIG. 1, a relatively large peripheral area is assigned to the cam recess 20 in the left-hand region. The tracer roller 16 maintains its position here when the drive shaft 18 is running fast and consequently the packaging machine is operating at high speed. The region of the cam recess 20 in the opposite end region of the cam body 17 is relatively narrow in the peripheral direction and therefore provided for slow rotary movements of the drive shaft 18 or of the packaging machine. The transitions between the cam flanks 21, 22 and the outer casing 19 are made obliquely, thus guaranteeing smooth running of the tracer roller 16.

In order to adjust the pressing-on time of the sealing jaw 12 on the pack 10, relative displacement between the tracer roller 16 and the cam body 17 takes place in the longitudinal direction of the cam recess 20. In the present exemplary embodiment, for this purpose the cam body 17 is adjusted, whilst the mounting of the pressing-on lever 13 remains fixed. In the present case, the cam body 17 is arranged on a sliding sleeve 23 which is mounted non-rotatably on the drive shaft 18, but so as to be displaceable in the longitudinal direction of the latter. The sliding sleeve 23 is equipped with a regulating gear which takes effect in response to changing working speeds of the packaging machine. In the present case, a (two-armed) actuating lever 24 is pivoted by a regulating member, for example a connecting rod (not shown) engaging on the free end of the actuating lever 24. This causes axial displacement of the sliding sleeve 23. For this purpose, the opposite end of the actuating lever 24 engages positively into a guide groove 25 in the sliding sleeve 23. To form the guide groove 25, annular discs 26 and 27 are attached to the sliding sleeve 23 at a distance from one another. The actuating lever 24 is pivotable about the pivot bearing 28.

Figure 2:
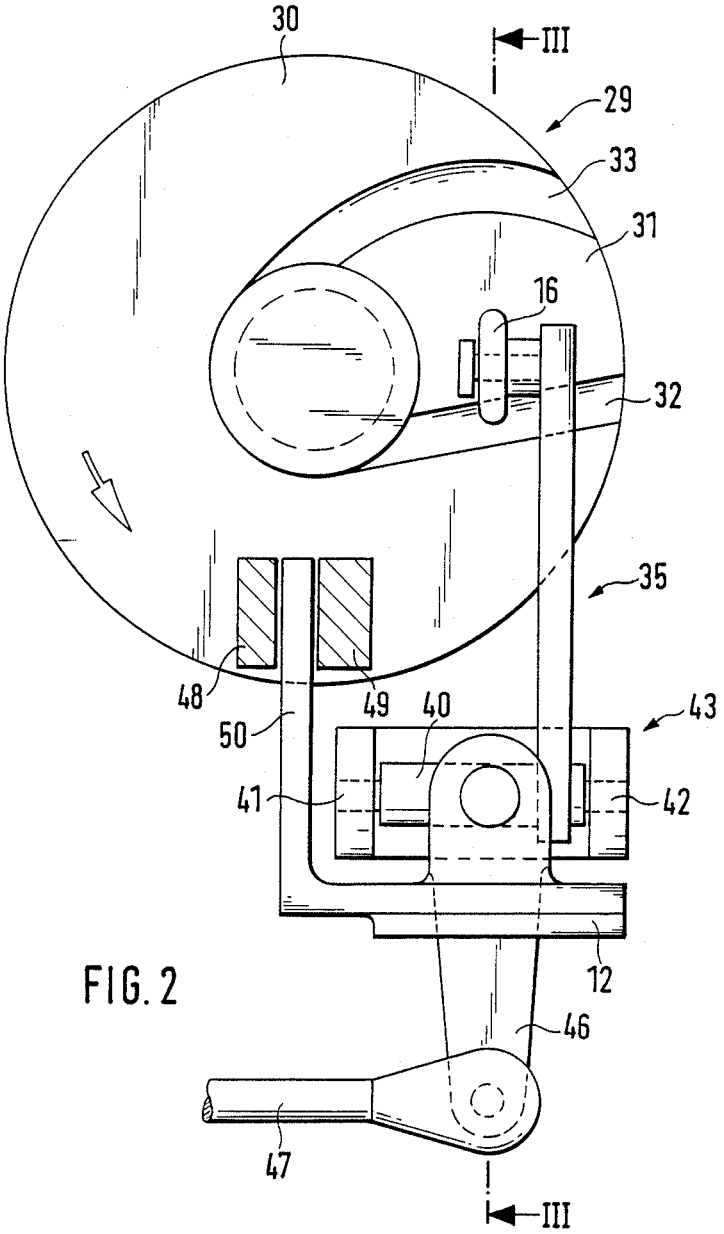
FIG. 2 shows another version of the device in a front view of a cam element.

The control of the actuating lever 24 for the axial displacement of the cam body can be carried out by means of a suitable known member for detecting the cycle time of the packaging machine, for example by means of a revolution counter which is assigned to a machine shaft of the packaging machine. The tracer roller 16, which is constantly up against the casing 19 of the cam body 17, is made crowned in the region of the contact face (see FIG. 2). As a result, the cam body 17 can shift transversely relative to the tracer roller 16 without difficulty.

Figure 3:
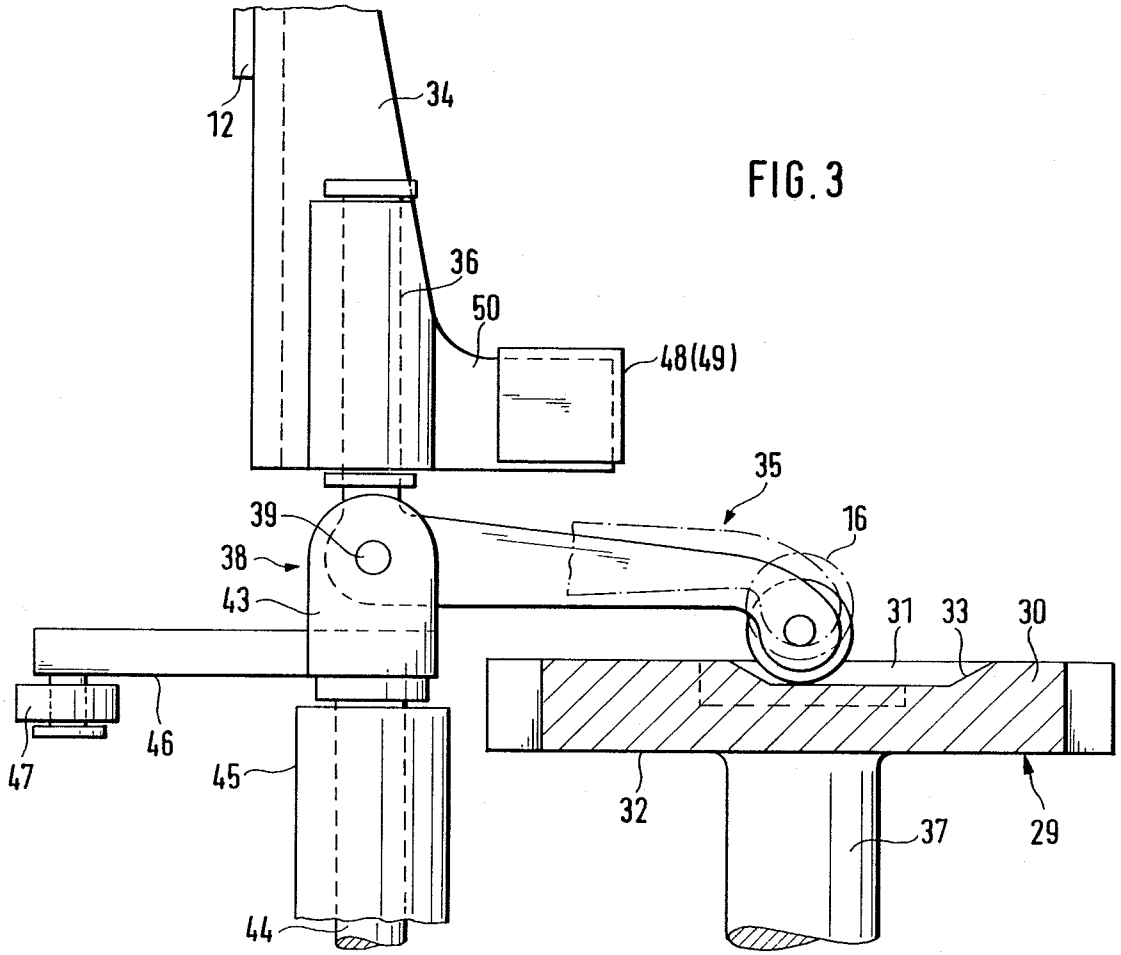
FIG. 3 shows a vertical section in the plane III—III of FIG. 2.

The exemplary embodiment according to FIGS. 3 and 4 puts the same basic technical idea into practice. Here, the cam element is a cam disc 29, that is to say a plate-shaped cam element. A cam recess 31 is made on a flat end control face 30 of the cam disc 29 and extends approximately in the radial direction from the centre of the cam disc, which here is circular, to the outer free edge. The cam recess 31 is designed with an effective width varying in the radial direction, so that, depending on the relative position, different pressing-on times for the sealing jaw 12 are sensed by the tracer roller 16 sensing the control face 30. For this purpose, one cam flank 32 of the cam recess 31 is made essentially straight, and an opposite cam flank 33 is made arcuate. The pressing-on times (sealing phase) of the sealing jaw 12 are determined as a result of the contact of the tracer roller 16 against the cam disc 29 in the region of the cam recess 31, whilst outside this the sealing jaw 12 is lifted off.

In the present exemplary embodiment, the sealing jaw 12 is attached to an angular jaw-holder 34 which is mounted rotatably on an angular pressing-on lever 35. A (right-hand) leg 36 of the pressing-on lever 35, assigned to the jaw-holder 34, is designed as a round rod. The jaw-holder 34 is mounted rotatably on this. Up-and-down movements of the tracer roller 16 are thus converted into pivoting movements of the pressing-on lever 35 and consequently of the leg 36 with the effect of lifting off or pressing on of the sealing jaw 12.

The cam disc 29 is driven to rotate, specifically by means of a drive shaft 37 which is connected directly or indirectly to the packaging machine by gearing and in any event, rotates at a speed corresponding to that of the latter. When the working speed (cycle time) of the packaging machine changes, the tracer roller 16 is adjusted in the radial direction in terms of its relative position on the control face 30 of the cam disc 29, specifically in the direction of the centre point of the cam disc 29, when the packaging machine runs more slowly, and towards the outer edge when it operates at a higher speed.

The tracer roller 16 and consequently the pressing-on lever 35 are adjusted by means of a regulating gear 38 which derives control signals from the current working speed of the packaging machine. In the present exemplary embodiment, the pressing-on lever 35 is pivoted as a result of the rotation of the rod-shaped leg 36 in an appropriate mounting on the jaw-holder 34. For this purpose, a pivot bearing 39 for the pressing-on lever 35 is connected to the regulating gear 38. The pivot bearing 39 is formed by a cross-pin 40 which is mounted, by means of bearing journals 41, 42, in a supporting fork 43 open on one side. The angular pressing-on lever 35 is connected firmly to the cross-pin 40 in the region of the angled portion. The supporting fork 43 is mounted rotatably in a firmly attached bearing sleeve 45 by means of the bearing bolt 44, so that the supporting fork 43 can execute pivoting movements about the axis of the bearing bolt 44.

Also fastened to the supporting fork 43 is a transversly projecting actuating arm 46 which, in part of the regulating gear 38, is connected to a connecting rod 47. The latter is part of a regulating member, for example a pressure-medium cylinder. As a result of the pivoting of the actuating arm 46, the supporting fork 43 rotates about the axis of the bearing bolt 44 and consequently the pressing-on lever 35 at the same time executes a pivoting movement about the leg 36. As a result, the tracer roller is adjusted in terms of its relative position on the cam disc 29.

The jaw-holder 34 is prevented from rotating, specifically by means of fixed supporting stops 48, 49 on both sides of a projecting supporting extension 50 on the jaw-holder 34.

In each of the above-described exemplary embodiments of the control device, the cam element executes one complete revolution for each work cycle of the packaging machine. The movement of the cam element is accordingly in synchronism with the cycle of movement of the packaging machine.

We claim:

1. Device for controlling the pressing-on time and for actuating a sealing jaw for sealing the folding tabs of a packaging blank in a packaging machine, comprising:

pressing-on lever means (13, 35) for cyclically pressing the sealing jaw (12) against a pack (10);

cam body means (17, 29) for moving said pressing-on lever means (13, 35);

said cam body means (17, 29) being a cam disc (17, 29) rotating in dependence on the operating speed of the packaging machine, and having an irregular formation of a curve to be traced; and tracer roller means (16), coupled to said pressing-on lever means (13, 35) and resting against said cam body means (17, 29), for operating the sealing jaw (12) and tracing over said cam body means as a result of relative movements, said cam body means (17, 29) being displaceable to present different cam portions to said tracer roller means (16) in dependence on changing operating speed of the packaging machine.

2. Device according to claim 1, characterized in that the cam body means (17, 29) executes one cycle of movement, especially one revolution, for each work cycle of the sealing jaw (12).

3. Device according to claim 1 or 2, characterized in that the cam body means comprises an elongated, cylindrical cam body (17), with a cam shape varying in the longitudinal direction, the cam body (17) and tracer roller means (16) being displaceable relative to one another in order to vary the effective cam shape.

4. Device according to claim 3, characterized in that the cam body (17) is displaceable relative to the tracer roller (16) in the axial direction.

5. Device according to claim 3, comprising rotary drive means for rotating the cam body (17), the tracer roller means (16) running on the periphery of a casing (19) of the cam body (17).

6. Device according to claim 3, characterized in that the cam shape of the cam body (17) is determined by a cam recess (20) extending in the longitudinal direction of the cam body (17) and located in the casing (19) of the latter, the sealing jaw (12) being in the pressing-on position during the running movement of the tracer roller means (16) in the region of the cam recess (20).

7. Device according to claim 4, characterized in that the cam body (17) is arranged on a sliding sleeve (23) which itself is mounted to be axially displaceable, but (relatively) non-rotatable, on a drive shaft (18) of the rotary drive means of the cam body (17).

8. Device according to claim 1, characterized in that the cam disc is a flat, round cam disc (29), with a control cam , formed on its front control face 30), for receiving said tracer roller means 16.

9. Device according to claim 8, characterized in that the control face (30) of the cam disc (29) is designed with a cam recess (31) which extends essentially in the radial direction and which determines the pressing-on time of the sealing jaw (12).

10. Device according to claim 8, characterized in that the tracer roller means (16), resting constantly against the control face (30), is adjustable in the radial direction relative to the cam disc (29) as a function of changes in the working speed (cycle rate) of the packaging machine.

11. Device according to claim 10, characterized in that said angular pressing-on lever means (35) for the sealing jaw (12) is pivotable in the radial direction relative to the cam disc (29), in order to adjust the tracer roller means (16), and comprising regulating gear means (38), controllable from the packaging machine, for pivoting said lever means (35).

12. Device according to claim 11, characterized in that one leg (36) of the pressing-on lever means (35) is remote from the tracer roller (16) and is mounted rotatably in a jaw-holder (34) for the sealing jaw (12).

* * * * *